United States Patent [19]

Odom

[11] 4,070,802

[45] Jan. 31, 1978

[54] SPRING-BIASED TAKE-UP CLAMP ASSEMBLY FOR MOBILE HOME TIE-DOWN STRAPS

[75] Inventor: James Thomas Odom, Columbia, Mo.

[73] Assignee: A. B. Chance Company, Centralia, Mo.

[21] Appl. No.: 695,648

[22] Filed: June 14, 1976

[51] Int. Cl.[2] ..... E04D 1/34

[52] U.S. Cl. ..... 52/23; 24/269; 24/68 CD; 52/DIG. 11

[58] Field of Search ..... 24/71 CT, 71 TD, 71 M, 24/68 CD, 68 B, 68 D, 269; 188/82.6, 77 W; 254/152, 151; 52/23, DIG. 11

[56] References Cited

U.S. PATENT DOCUMENTS

| | | | |
|---|---|---|---|
| 2,387,711 | 10/1945 | Barr | 188/77 W |
| 2,815,189 | 12/1957 | Woods | 188/82.6 |
| 3,845,597 | 11/1974 | Foster | 52/23 |

FOREIGN PATENT DOCUMENTS

| | | | |
|---|---|---|---|
| 295,635 | 3/1954 | Switzerland | 24/68 B |

*Primary Examiner*—Ernest R. Purser
*Assistant Examiner*—Henry Raduazo
*Attorney, Agent, or Firm*—Schmidt, Johnson, Hovey & Williams

[57] ABSTRACT

An improved, spring-biased take-up clamp assembly for elongated tie-down elements such as cables, ropes or mobile home tie-down straps is provided which permits simplified, infinitely adjustable take-up and tightening of the tie-down element with secure locking at any desired position and without the use of conventional turnbuckles or other devices using interference-fit structure for spindle-retaining purposes. In preferred forms the assembly includes a rotatable take-up mandrel or spindle for a tie-down element, an apertured mounting plate fixed to the upper end of an embedded earth anchor, and a motion-checking snubber spring operatively coupled between the strap spindle and mounting plate for holding the strap against loosening under tension loads while at the same time permitting relatively easy, one-man tightening thereof as desired. The snubber spring includes a pair of spaced torsion spring portions in gripping engagement with the wind-up spindle, and a bail portion engageable with the anchor mounting plate for preventing inadvertent slippage of the hold-down element.

17 Claims, 7 Drawing Figures

SPRING-BIASED TAKE-UP CLAMP ASSEMBLY FOR MOBILE HOME TIE-DOWN STRAPS

This invention relates to novel, spring-biased take-up clamp apparatus adapted for securing tie-down elements such as cables, ropes or straps and the like to anchoring structure without the need for conventional turnbuckles or the like heretofore used for these purposes. More particularly, it is concerned with a clamp assembly especially adapted for mobile home tie-down straps which provide tensioning apparatus permitting simplified,infinitely adjustable take-up and tightening of a strap in a simple, one-man operation.

In recent years many states and local governments have enacted regulations making it mandatory that mobile homes be securely anchored to the earth to resist adverse effects from high winds. These increasingly stringent regulations have come into being because of past experience with mobile homes wherein the latter have been severely damaged or even picked up and completely destroyed during high wind conditions. The most common type of anchoring system used with mobile homes involves embedded helical earth anchors in combination with tie-down straps which extend over the top of the mobile home and are clamped or otherwise secured to the embedded earth anchors. Of course, in order to be successful, any such tie-down system must provide a secure connection between the tie-down straps and earth anchors, or failures may result at these points. In addition, it is necessary that the clamp assemblies used for this purpose provide means for tightening the straps during initial installation thereof and over time as the need arises.

A number of take-up clamp assemblies have been suggested in the past, both for use with mobile home tie-down apparatus and for more general purposes. For example, turnbuckle assemblies have been extensively used for these purposes and are well-known in the art. In addition, various types of take-up clamp assemblies employing interference-fit principles have been proposed. For example, in U.S. Pat. No. 3,416,763, a threaded, axially slotted, strap-receiving mandrel bolt is provided which is supported in apertured yoke structure. One leg of the yoke structure is configured to present a square aperture which is adapted to receive a complementary square portion formed on the mandrel bolt. In this way the bolt can be rotated to take up the tie-down strap, whereupon it can be laterally shifted so that the square portion of the bolt is received within the complementary yoke aperture to prevent unwinding of the strap. Other types of clamp assemblies are disclosed in U.S. Pat. Nos. 3,551,504, 3,051,445, 3,638,912, 3,652,027, 3,673,642, 3,747,288, 3,754,733, 3,845,597, 3,856,265, 3,871,142 and 3,894,365.

Although a number of take-up clamp assemblies have achieved a certain degree of commercial success, a number of unresolved problems remain. Specifically, in the case of interference-fit clamp assemblies for use with mobile home tie-down straps, one objection stems from the fact that they are not infinitely adjustable. That is, it is necessary with such devices to rotate the take-up mandrel to a point where it will be complementally received by the supporting apertured clevis structure. Thus, care must be taken in winding the mandrel in order to ensure that a proper rotational position is reached at the point of desired tensioning. In addition, since the hold-down straps presently in use are formed of high tensile strength steel, when wrapped around a take-up mandrel they tend to act as a coiled spring. Thus, if the mandrel is released during the tensioning procedure, the coiled strap tends to unwind; therefore, it is necessary to hold the mandrel against such unwinding at each point during the take-up operation, and this makes strap tensioning a two-man job. Another disadvantage of the split-mandrel interference-fit type of clamp assembly results from the fact that a lateral movement of the mandrel is required in order to lock the same against rotation. This is generally accomplished by hammering the mandrel into the clevis opening which can have the effect of creasing or otherwise damaging the hold-down strap itself.

It is therefore the most important object of the present invention to provide an adjustable take-up clamp assembly especially adapted for use in securing tie-down elements such as cables, ropes or straps to anchoring structure such as mobile home anchors and which is infinitely adjustable during the tightening sequence and lockable at any desired position so that installation and adjustment of the assembly is a simple, one-man operation.

Another object of the invention is to provide a take-up clamp assembly of the type described which includes an elongated, axially rotatable spindle for receiving one end of a tie-down element, in conjunction with mounting structure for the spindle fixed to anchoring means such as an embedded earth anchor, and snubber spring means coupling the spindle and mounting structure for precluding significant loosening of the strap under tension loads normally experienced in practice; in preferred forms the spring means includes a first portion such as a torsion spring in gripping engagement with the spindle, and a second portion engageable with the mounting structure for preventing unwinding of the tie-down strap.

Another object of the invention is to provide a spring-biased clamp assembly including a rotatable strap spindle which can be adjusted as desired for tensioning a hold-down strap, and which provides snubber spring means for locking the strap at any desired tension against the tendency of the strap to unwind; in this fashion a single operator can install and adjust the clamp assembly hereof by simply rotating the spindle with an appropriate hand tool.

Finally, another object of the invention is to provide a tensioning device for use in a tie-down assembly which includes anchoring means and a tie-down strap, the device having an elongated strap-receiving spindle and snubber spring means secured to the spindle for mounting of the latter adjacent appropriate mounting structure and permitting the strap to be tensioned as required and held securely against loads imosed thereon in practice; in preferred forms, the spring means includes a pair of spaced torsion spring portions respectively in gripping engagement with the spindle, and a bail portion interconnected between the torsion spring portions and having a bight section in spaced relationship to the spindle.

Figure 7:
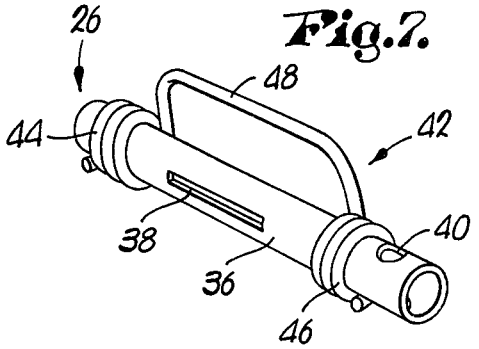
Figure 6:
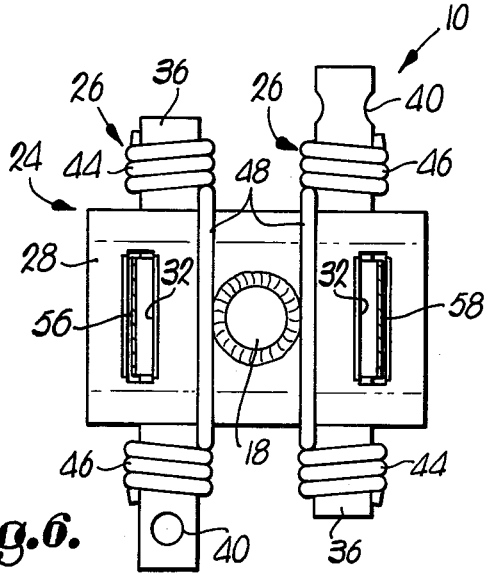

FIG. 6 is a plan view of the clamp assembly shown with a pair of tensioning devices operatively secured adjacent opposite ends of the transversely extending spindle-mounting plate; and FIG. 7 is a perspective view of a strap tensioning device including elongated, axially slotted spindle and spring means having spaced torsion spring portions in gripping engagement with the spindle and a bail portion interconnecting the torsion spring portions.

Figure 1:
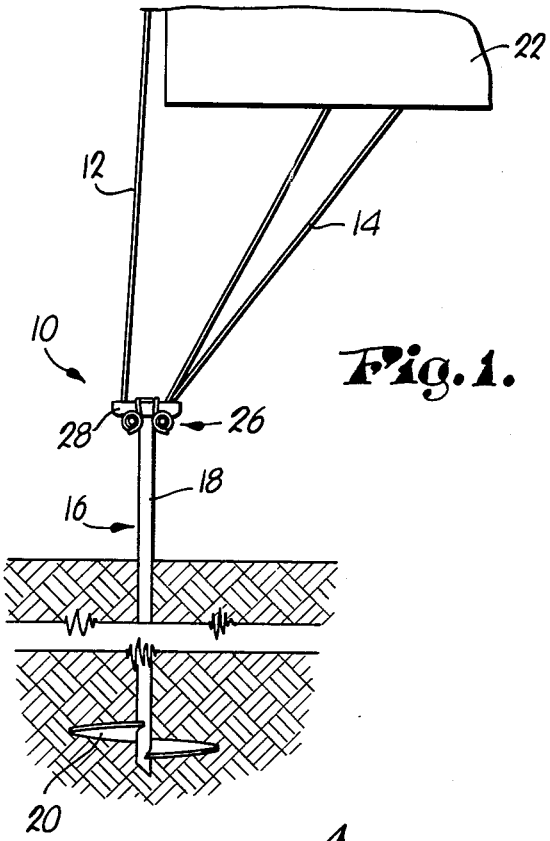
FIG. 1 is a fragmentary, essentially schematic view of the take-up clamp assembly of the present invention as it would appear in use for connecting an embedded earth anchor and the tie-down straps of a mobile home.

A clamp assembly 10 is illustrated in its preferred environment of use in FIG. 1. In this context, assembly 10 is employed to tensionably secure a pair of elongated, metallic, web-like hold-down straps 12 and 14 to a conventional mobile home anchor 16. The latter includes an elongated shaft 18 having one end thereof protruding from the earth, and a generally transversely extending load-bearing helix 20 adjacent the embedded end of the shaft. As illustrated in FIG. 1, strap 12 passes over the top of mobile home 22, while strap 14 is wrapped around an underlying frame member (not shown) forming a part of the mobile home. In the case of strap 12, one end thereof is received and secured by the clamp assembly, while both ends of strap 14 are received and held by the opposite side of the assembly.

Broadly, clamp assembly 10 includes mounting structure 24 adapted to be affixed to the uppermost end of anchor shaft 18 as illustrated, in conjunction with a tensioning device 26 which is cooperable with structure 24 for adjustably securing a tie-down strap or the like in a manner to be described hereinafter.

In more detail, mounting structure 24 preferably includes a mounting plate 28 which is generally U-shaped in cross-section to present spaced, spindle-engaging legs 30. In addition, plate 28 includes a pair of transversely extending, strap-receiving slots 32 therein adjacent the respective ends of the plate. As best seen in FIGS. 3–6, plate 28 is centrally apertured as at 34 for receiving the uppermost end of anchor shaft 18, and the latter is welded to plate 28 as illustrated. Although plate 28 is depicted with the longitudinal axis thereof disposed transversely of the axis of shaft 18, it will be understood that other types of mountings are possible.

Tensioning device 26 (see FIG. 7) includes an elongated, generally tubular mandrel or spindle 36 which has an elongated, axially extending, strap-receiving slot 38 therein and a pair of mated, tool-receiving apertures 40 adjacent one end thereof. Snubber spring means broadly referred to by the numeral 42 includes spaced torsion spring portions 44 and 46 and an interconnecting bail portion 48 having a central bight segment thereof in spaced, generally parallel relationship to spindle 36. As will be seen from a study of FIG. 7, the respective torsion spring portions 44 and 46 are in gripping engagement with spindle 36, with the coils thereof being of a diameter slightly less than the outside diameter of spindle 36. In addition, each of the leg portions of bail 48 is tangential to spindle 36 and is connected to and forms a part of the innermost convolution of the corresponding torsion spring portion. In this regard, it will be noted that torsion spring portion 46 is wrapped about spindle 36 in a clockwise fashion (proceeding from the bail leg), while portion 44 is wrapped in a counterclockwise manner about the spindle.

Figure 3:
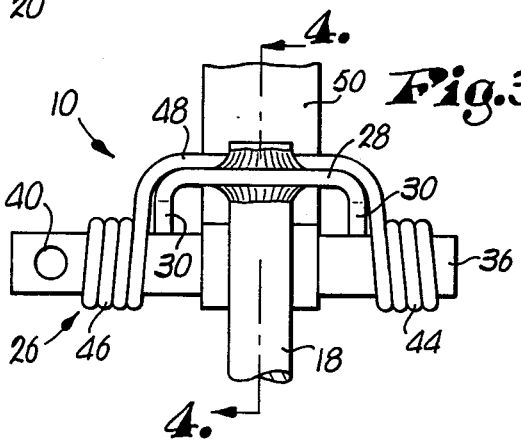
FIG. 3 is a fragmentary end elevational view of the clamp assembly illustrated in FIG. 2.
Figure 2:
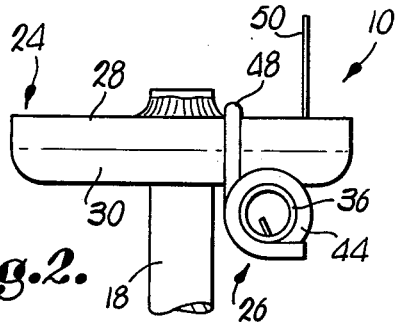
FIG. 2 is a fragmentary side elevational view of the present clamp assembly mounted atop the shaft of an earth anchor.
Figure 4:
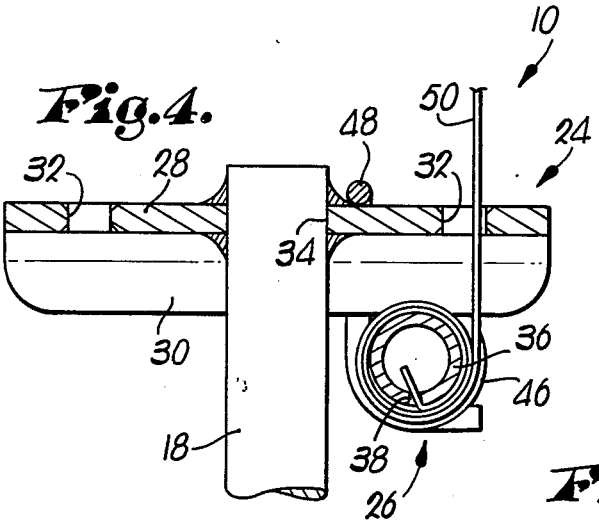
FIG. 4 is a vertical sectional view taken along line 4—4 of FIG. 3 and further illustrating the details of the clamp assembly.

In use, tensioning device 26 is mounted on plate 28 simply by passing bail portion 48 over the top of plate 28 in the manner best illustrated in FIG. 3. In this orientation the undersides of the legs 30 engage spindle 36 on opposite sides of strap-receiving slot 38, while bail portion 48 is in engagement with the upper surface of plate 28 remote from spindle 36. During initial installation operations when anchor 16 has been properly embedded into the earth, one end of a strap 50 (see FIGS. 2–5) is passed through aperture 32 and the extreme end of the strap is placed within slot 38 in spindle 36. At this point an appropriate tool 52 (see FIG. 5) can be inserted into the mated apertures 40 in spindle 36 and rotated in the direction illustrated by arrow 54. This causes spindle 36 to be axially rotated in a clockwise fashion as viewed in FIG. 5, so that the end of strap 50 is progressively wrapped around spindle 36.

In this regard, clockwise rotation of spindle 36 causes bail 48 to engage the upper surface of plate 28 in a direction counter to the windings of the respective torsion spring portions 44 and 46. This in turn tends to loosen the gripping engagement of the portions 44 and 46 and allows relatively free rotation of spindle 36. This adjustment of strap 50 continues until a desired degree of tensioning is reached, whereupon tool 52 is disengaged and bail portion 48 returns to its normal plate-engaging configuration illustrated in FIG. 2. In this orientation, any tension loads experienced by strap 50 which would tend to rotate spindle 36 in a counterclockwise or strap-unwinding direction have the effect of tightening the gripping engagement of the spring portions 44 and 46 about the spindle. Thus, during such loading the clamp assembly tightens so that unwinding of strap 50 is positively precluded.

It should also be noted that the installer can interrupt rotation of spindle 36 at any time without fear that the strap will loosen or unwind. In essence, each time rotation is stopped, spring means 42 returns to its normal holding configuration against the rotational unwinding forces imposed thereon by virtue of the end of strap 50 wrapped about spindle 36. This of course permits successive one-turn windings of strap 50 about spindle 36 without any of the problems encountered with prior take-up clamp assemblies. Furthermore, since the present clamp assembly is devoid of interference-fit structure common with prior units, it will be seen that tightening of strap 50 can be stopped at any rotational position of spindle 36 without adverse results.

Figure 5:
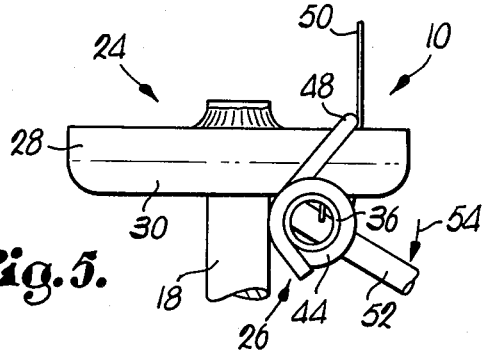
FIG. 5 is a side elevational view similar to FIG. 2 but illustrates the clamp assembly during the strap-tightening sequence wherein an appropriate tool is employed to rotate the strap spindle.

If it is desired to loosen strap 50 after the latter has been tensioned, it is only necessary to apply an unwinding force to the tag ends of the respective torsion springs 44 and 46, whereupon spindle 36 can be rotated by using tool 52 in a counterclockwise direction as viewed in FIG. 5 to permit unwinding of strap 50.

Referring specifically to FIG. 6, it will be seen that a single plate 28 can be employed for securing two separate hold-down straps 56 and 58 through the use of separate, identical tensioning devices 26. Of course, the installation of the separate straps to the respective devices 26 is identical with that of strap 50, and a description of this operation need not be repeated. However, it will be noted that the tool-engaging ends of the respective spindles 36 are preferably disposed on opposite sides of plate 28, so that no interference is presented to tightening either of the tensioning devices through the use of tool 52.

Having thus described the invention, what is claimed as new and desired to be secured by Letters Patent is:

1. A clamp assembly for securing an element such as an elongated cable or strap to anchoring structure, comprising:

mounting structure presenting first and second engagement surfaces and adapted to be affixed to said anchoring structure; and axially rotatable spindle means for receiving one end of said element and in engagement with said first engagement surface;

spring means operatively coupling said spindle means and mounting structure for precluding significant loosening of the element under tension loads normally experienced thereby, said spring means including a first portion in gripping engagement with said spindle means, and a second portion in engagement with said second engagement surface, said mounting structure being located between said spindle means and the part of said second portion in engagement with said second surface, said second spring portion being loaded in tension.

2. The clamp assembly as set forth in claim 1 wherein said spindle means is configured to present an axially extending, strap-receiving slot for receiving one end of a tie-down strap.

3. The clamp assembly as set forth in claim 1 wherein said spindle means is configured to present a tool-engaging opening adjacent one end thereof for receiving a winding tool.

4. The clamp assembly as set forth in claim 1 wherein said mounting structure includes spaced, spindle means-engaging legs in contact with said spindle means on opposite sides of said element.

5. The clamp assembly as set forth in claim 4 wherein said mounting structure is configured to present an element-receiving slot therein.

6. The clamp assembly as set forth in claim 1 wherein said spring means comprises spaced torsion spring portions respectively in gripping engagement with said spindle means, and a bail portion interconnecting said torsion spring portions and in engagement with said second engagement surface of said mounting structure for precluding said element loosening.

7. The clamp assembly as set forth in claim 6 wherein said mounting structure includes a plate-like member having opposed first and second surfaces, said spindle means being in engagement with said first surface, said bail portion being in engagement with the opposed second surface.

8. The clamp assembly as set forth in claim 6 wherein said torsion spring portions are configured for loosening when said spindle is rotated in a direction for take-up winding of said element about the spindle means.

9. The clamp assembly as set forth in claim 6 wherein one of said torsion spring portions is wound in a clockwise fashion about said spindle means, and the remaining torsion spring portion is wound in a counterclockwise manner about the spindle means.

10. A tie-down assembly for securing mobile homes or the like, comprising:

an earth anchor adapted to be embedded within the earth and including an elongated shaft having the upper end thereof protruding from the earth, and a generally transversely extending load-bearing member attached to said shaft adjacent the lower embedded end thereof;

a mounting plate secured to said protruding end of the anchor shaft;

an elongated, axially slotted and rotatable spindle in engagement with one side of said mounting plate;

an elongated tie-down strap having one end thereof inserted within said spindle slot and wrapped around the spindle; and spring means including spaced torsion spring portions respectively in gripping engagement with said spindle and on opposite sides of said strap, and a bail portion connected between said torsion spring portions and engaging the side of said mounting plate remote from said spindle, said torsion spring portions being configured for loosening upon axial rotation of said spindle in a direction for takeup winding of said strap about the spindle, and for substantially blocking rotation of said spindle in a direction for loosening of the strap.

11. The tie-down assembly as set forth in claim 10 wherein said mounting plate is mounted with the longitudinal axis thereof generally transverse of the axis of said shaft.

12. The tie-down assembly as set forth in claim 10 wherein said mounting plate is slotted for receiving and guiding said strap.

13. A tensioning device for use in a tie-down assembly including anchoring means and an elongated tie-down element, said device comprising:

an elongated element-receiving spindle;

spring means including a pair of spaced torsion spring portions respectively in gripping engagement with said spindle, and a bail portion interconnected between said torsion spring portions and having a bight section in spaced relationship to said spindle; and means for engaging said bail portion for holding said element against loosening under tension loads experienced by the latter.

14. The tensioning device as set forth in claim 13 wherein said bail portion includes spaced legs connected to said bight section on opposite sides of the latter, said legs each being connected to the innermost convolution of a corresponding torsion spring portion.

15. The tensioning device as set forth in claim 14 wherein one of said torsion spring portions is wound in a clockwise fashion about said spindle, and the remaining torsion spring portion is wound in a counterclockwise manner about the spindle.

16. The tensioning device as set forth in claim 13 wherein said spindle is configured to present an axially extending, element-receiving slot between said torsion spring portions.

17. A clamp assembly for securing a tie-down element such as an elongated cable or strap to anchoring structure, comprising:

axially rotatable spindle means for receiving one end of said element;

mounting structure for said spindle means and adapted to be affixed to said anchoring structure; and spring means operatively coupling said spindle means and mounting structure for precluding significant loosening of the element under tension loads normally experienced thereby, said spring means comprising spaced torsion spring portions respectively in gripping engagement with said spindle means, and a bail portion interconnecting said torsion spring portions and engageable with said mounting structure for precluding loosening of said element.

* * * * *